US009556006B2

(12) United States Patent
Schneider et al.

(10) Patent No.: US 9,556,006 B2
(45) Date of Patent: Jan. 31, 2017

(54) METHOD FOR CONTROLLING THE ORIENTATION OF A CRANE LOAD AND A BOOM CRANE

(71) Applicant: Liebherr-Werk Nenzing GmbH, Nenzing (AT)

(72) Inventors: Klaus Schneider, Hergatz (DE); Oliver Sawodny, Stuttgart (DE); Ulf Schaper, Stuttgart (DE); Eckhard Arnold, Ilmenau (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 0 days.

(21) Appl. No.: 14/728,845

(22) Filed: Jun. 2, 2015

(65) Prior Publication Data

US 2015/0344271 A1 Dec. 3, 2015

(30) Foreign Application Priority Data

Jun. 2, 2014 (DE) ..... 10 2014 008 094

(51) Int. Cl.

| | |
|---|---|
| ***B66C 13/04*** | (2006.01) |
| ***B66C 13/06*** | (2006.01) |
| ***B66C 13/08*** | (2006.01) |
| ***B66C 13/46*** | (2006.01) |

(52) U.S. Cl.

CPC ..... *B66C 13/04* (2013.01); *B66C 13/06* (2013.01); *B66C 13/063* (2013.01); *B66C 13/08* (2013.01); *B66C 13/085* (2013.01); *B66C 13/46* (2013.01)

(58) Field of Classification Search

CPC ..... B66C 13/04; B66C 13/085; B66C 13/46; B66C 13/08; B66C 13/063; B66C 13/06; H01Q 1/2283; H01Q 1/36; H01L 21/302; H01L 23/66; H01L 21/486; H01L 23/5227; H01L 21/50; H01L 2224/04042; H01L 2224/0557; H01L 2224/0401; H01L 2224/16225; H01L 2223/6677

See application file for complete search history.

(56) References Cited

U.S. PATENT DOCUMENTS

| | | | | |
|---|---|---|---|---|
| 5,961,563 | A * | 10/1999 | Overton | B66C 13/063 212/272 |
| 6,601,718 | B2 | 8/2003 | Sawodny et al. | |
| 7,426,423 | B2 | 9/2008 | Schneider et al. | |
| 7,850,025 | B2 | 12/2010 | Neupert et al. | |
| 8,025,167 | B2 | 9/2011 | Schneider et al. | |

(Continued)

FOREIGN PATENT DOCUMENTS

| | | |
|---|---|---|
| DE | 10029579 A1 | 1/2002 |
| DE | 10324692 A1 | 1/2005 |

(Continued)

*Primary Examiner* — Rodney Butler

(74) *Attorney, Agent, or Firm* — Alleman Hall McCoy Russell & Tuttle LLP

(57) ABSTRACT

The present disclosure relates to a method for controlling the orientation of a crane load, wherein a manipulator for manipulating the load is connected by a rotator unit to a hook suspended on ropes and the skew angle ηL of the load is controlled by a control unit of the crane, characterized in that the control unit is an adaptive control unit wherein an estimated system state of the crane system is determined by use of a nonlinear model describing the skew dynamics during operation.

15 Claims, 9 Drawing Sheets

(56) References Cited

U.S. PATENT DOCUMENTS

| | | | | |
|---|---|---|---|---|
| 8,235,231 | B2 | 8/2012 | Schneider et al. | |
| 8,839,967 | B2 | 9/2014 | Schneider et al. | |
| 2005/0224438 | A1* | 10/2005 | Maurer | B66C 13/063 212/274 |
| 2008/0156761 | A1* | 7/2008 | Schneider | B66C 13/063 212/273 |
| 2015/0291400 | A1* | 10/2015 | Rintanen | B66C 13/46 700/214 |

FOREIGN PATENT DOCUMENTS

| | | | |
|---|---|---|---|
| DE | 102006033277 | A1 | 2/2008 |
| DE | 102008024513 | A1 | 11/2009 |
| DE | 102009032267 | A1 | 1/2011 |
| DE | 202008018260 | U1 | 5/2012 |
| EP | 1334945 | A2 | 8/2003 |

* cited by examiner

Fig. 12
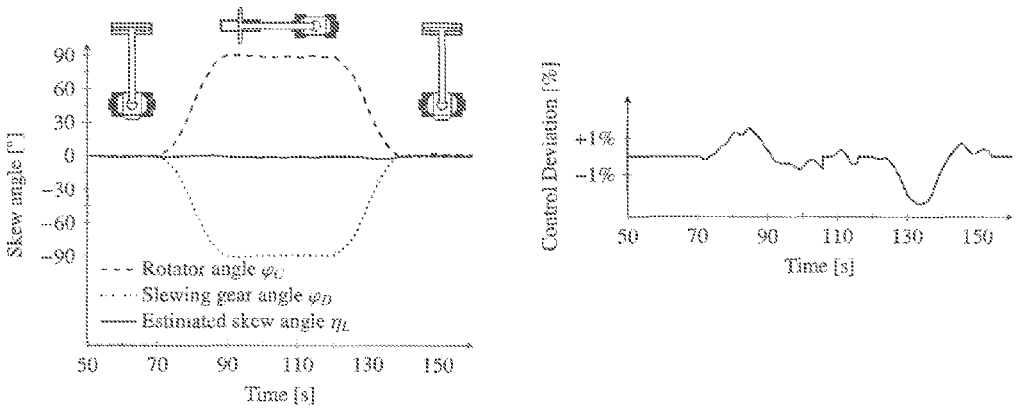
Fig. 13A
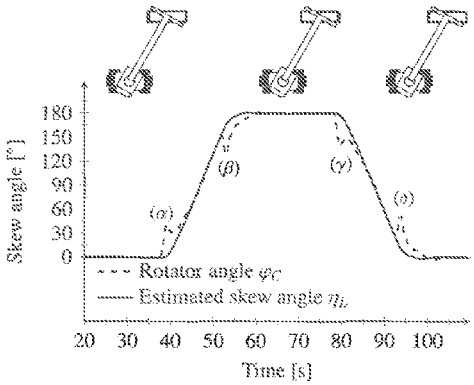
Fig. 13B
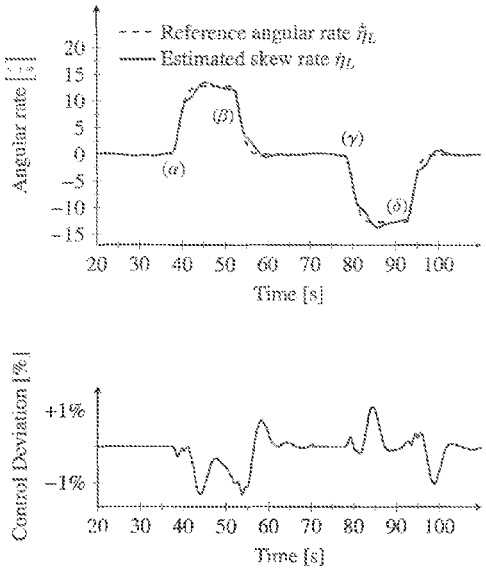
Fig. 13C

METHOD FOR CONTROLLING THE ORIENTATION OF A CRANE LOAD AND A BOOM CRANE

CROSS REFERENCE TO RELATED APPLICATION

This application claims priority to German Patent Application No. 10 2014 008 094.3, entitled "Method for Controlling the Orientation of a Crane Load and a Boom Crane" filed on Jun. 2, 2014, the entire contents of which is hereby incorporated by reference in its entirety for all purposes.

TECHNICAL FIELD

The present disclosure relates to a method for controlling the orientation of a crane load, wherein a manipulator for manipulating the load is connected by a rotator unit to a hook suspended on ropes and the skew angle of the load is controlled by a control unit of the crane.

BACKGROUND AND SUMMARY

In small and midsize harbours, boom cranes are used for multiple applications. These include bulk cargo handling and container transloading. An example for a boom crane used in small and midsize harbours with mixed freight types is depicted in FIG. 1. Currently, the level of process automation is comparatively low and container transloading is done manually by crane operators. However, the general trend of logistic automation in harbours requires higher container handling rates, which can be achieved by increasing the level of process automation.

On boom cranes, containers are mounted to the crane hook using spreaders (manipulators), see FIG. 2. Spreaders can only be locked to containers after they have been precisely landed on them. This means that the position and the orientation of the spreader have to be adapted to the container for successfully grabbing the container with the spreader. The spreader orientation, which is also defined as the skew angle, is controlled using a hook-mounted rotator motor.

Since wind, impact, and uneven load distribution can cause skew vibrations, an active skew control is desirable for facilitating crane operation, improving positioning accuracy, and increasing turnover. Positioning the spreader requires damping the pendulum oscillations, which can be done either manually by the operator or automatically using anti-sway systems. Adapting the spreader orientation requires damping the torsional oscillations ("rotational vibrations" or "skewing vibrations") using a rotational actuator, which is regularly done manually.

A few technical solutions for a skew control are known from the state of the art and which are mostly designed for a gantry crane. Due to specific properties of such cranes these implementations of skew controls are mostly not compliant with differing crane designs. In particular boom cranes comprise a longer rope length and a much smaller rope distance which yields to lower torsional stiffness compared to gantry cranes. This increases the relevance of constraints and also results in lower eigenfrequencies. Second, arbitrary skew angles are possible on boom cranes, while gantry cranes can only reach skew angles of a few degrees. Third, the well-established visual load tracking mechanism of gantry cranes using cameras and markers cannot be applied to boom cranes.

For instance, a solution for a skew control system is known from EP 1 334 945 A2 performing optical position measurements (e.g. camera based) for detecting the skew angle. However, such system may become unavailable during night or during bad weather conditions.

Another method for controlling the orientation of the crane load is known from DE 100 29 579 and DE 10 2006 033 277 A1. There, the hook suspended on ropes has a rotator unit containing a hydraulic drive, such that the manipulator for grabbing containers can be rotated around a vertical axis. Thereby, it is possible to vary the orientation of the crane loads. If the crane operator or the automatic control gives a signal to rotate the manipulator and thereby the load around the vertical axis, the hydraulic motors of the rotator unit are activated and a resulting flow rate causes a torque. As the hook is suspended on ropes, the torque would result in a torsional oscillation of the manipulator and the load. To position the load at a specific angle, this torsional oscillation has to be compensated. However, the solutions known from DE 100 29 579 and DE 10 2006 033 277 A1 use linear models for describing the skew motion. Such linear models are only valid in a small neighborhood around the steady state, i.e. only small deflection angles can be used. Further, the systems known from DE 100 29 579 and DE 10 2006 033 277 A1 employ a state observer which needs the second derivative of a position measurement. Such a double differentiation is disadvantageous due to noise amplification. Furthermore, both systems known from DE 100 29 579 and DE 10 2006 033 277 A1 require knowledge of the load inertia which varies heavily with the load mass. Especially in DE 10 2006 033 277 A1, a time-consuming calculation method is used for estimating the load inertia.

It is the objection of the present disclosure to provide an improved method for controlling the skew angle of a crane, in particular of a boom crane.

The aforementioned object is solved by a method performed on a control unit of a crane comprising a manipulator for manipulating the orientation of a load connected by a rotator unit to a hook suspended on ropes. For improvement of the operating of the crane the skew angle of the load is controlled by a control unit of the crane.

In the following, a rotation of the manipulator (spreader) and/or crane load (e.g. container) around the vertical axis is described as skew motion. The heading or yaw of a load is called skew angle and rotation oscillations of the skew angle are called skew dynamics.

The expression hook defines the entire load handling devic excluding the spreader.

A control of the skew angle normally requires a feedback signal which is usually based on a measurement of the current system status. However, implementation of a skew control according to the present disclosure requires states of the boom crane which cannot be measured or which are too disturbed to be used as feedback signals.

Therefore, the present disclosure recommends that one or more required states are estimated on the basis of a model describing the skewing dynamics during the crane operation. Further, a nonlinear model is used for describing the skew dynamics of the crane during operation instead of a linear model as currently applied by known skew controls. Implementation of a non-linear model enables consideration of the non-linear behaviour of the skew dynamics over a wider range or the full range of the possible skewing angle of the load. Since boom cranes permit a significantly larger skewing angle than gantry cranes the present disclosure essentially improves the performance and stability of the skew control applied to boom cranes.

According to the present disclosure a non-linear model is used which allows using larger deflection angles (up to90°). Larger deflection angles yield larger reactive torques and therefore faster motion.

Further, the present disclosure does not require any optical sensors to improve the system availability and system reliability. No optical position measurement has to be performed for detecting the skew angle as known from the state of the art.

In the method for controlling the orientation of a crane load of the present disclosure, torsional oscillations are avoided by an anti-torsional oscillation unit using the data calculated by the dynamic non-linear model. This anti-torsional oscillation unit uses the data calculated by the dynamic non-linear model to control the rotator unit such that oscillations of the load are avoided. The anti-torsional oscillation unit can generate control signals that counteract possible oscillations of the load predicted by the dynamical model. The rotator unit includes an electric and/or hydraulic drive. The anti-torsional oscillation unit can generate signals for activating the rotator motor, thereby applying torque generated by a hydraulic flow rate or electric current.

In particular, the non-linearity included in the model describing the skew dynamics refers to the non-linear behaviour of the resulting reactive torque caused by torsion of the load, i.e. the ropes. For instance, the reactive torque increases until a certain skew angle of the load is reached, for instance of about 90 degrees. By excessing said certain skew angle the reactive torque decreases due to twisting of the ropes. The skew dynamic model optionally includes one or more non-linear terms or expressions representing the non-linear behaviour as described before.

Former controller architectures as described before require the mass of the load and most importantly, the moment of inertia of the load as an input parameter. However, the distribution of mass inside the load, e.g. a container, is unknown and therefore the moment of inertia of the load is not known, either. Therefore, known prior art control architectures estimate the moment of inertia of the load on the basis of a complex and computationally intensive process. According to an example aspect of the present disclosure the implemented non-linear model for estimation of the system state is independent on the load mass and/or the moment of inertia of the load mass. Consequently, the performance of the skew control significantly increases while reducing the processor load and usage of the control unit.

In particular, the method according to a further preferable aspect does not require a Kalman filter for estimation of the system state.

In an example embodiment of the present disclosure the estimated system state includes the estimated skew angle and/or the velocity of the skew angle and/or one or more parasitic oscillations of the skew system. A possible parasitic oscillation which influences the skew dynamics may be caused by the slackness of the hook, for instance. Further, system state may further include besides the estimates parameters several parameters which are directly or indirectly measured by measurement means of the crane.

The control unit may be based on a two-degree of freedom control (2-DOF) comprising a state observer for estimation of the system state, a reference trajectory generator for generation of a reference trajectory in response to a user input and a feedback control law for stabilization of the nonlinear skew dynamic model.

This means that a control signal for controlling the rotator drive of the rotator unit and/or a slewing gear and/or any other drive of the crane comprises a feedforward signal from the reference trajectory generator and a feedback signal to stabilize the system and reject disturbances. The feedforward control signal is generated by the reference trajectory generator and designed in such a way that it drives the system along a reference trajectory under nominal conditions (nominal input trajectory). Deviation from a nominal state (nominal state trajectory) defined by the reference trajectory generator are determined by using the estimated state determined by the state observer on the basis of the non-linear model for skew dynamics. Any deviation is compensated by a feedback signal determined from the nominal and estimated state using a feedback gain vector. The resulting compensated signal is used as the feedback signal for generation of the control signal.

For estimation of the system state considering the skew dynamics the state observer optionally receives measurement data comprising at least the drive position of the rotator unit and/or the inertial skewing rate and/or the slewing angle of the crane. These parameters may be measured by certain means installed at the crane structure. For instance, the drive position of the rotator may be measured by an incremental encoder. Since the incremental encoder gives a reliable measurement signal the drive speed may be calculated by discrete differentiation of the drive position. Further, a gyroscope may be installed at the hook, in particular the hook housing, for measuring the inertial skewing rate of the hook. Said gyroscope measurement may be disturbed by a signal bias and a sensor noise. The slewing angle of the crane may be measured by another sensor, for instance an incremental encoder installed at the slewing gear.

Furthermore, the rope length may be measured precisely and a spreader length used for grabbing a container may be derived from a spreader actuation signal. It may be possible to calculate the radius of gyration from the spreader length.

A good quality for estimation of the system state is achieved by using a state observer of a Luenberger-type. However, any other type of a state observer may be applicable.

The state observer may be implemented without the use of a Kalman filter since the model for characterizing the skew dynamic is independent of the load mass and/or the moment of inertia of the load mass.

As described before, the systems known from DE 100 29 579 and DE 10 2006 033 277 A1 employ a state observer which needs the second derivative of a position measurement. Such a double differentiation is disadvantageous due to noise amplification. According to an example aspect of the present disclosure the used coordinate system for describing the state of the system has been changed to an extent that the present disclosure does not require double differentiation.

It is advantageous when the reference trajectory generator calculates a nominal state trajectory and/or a nominal input trajectory which is/are consistent with the crane dynamics, i.e. skew dynamics and/or rotator drive dynamics and/or measured crane tower motion. Consistency with skew dynamics means that the reference trajectory fulfills the differential equation of the skew dynamics and does not violate skew deflection constraints. Consistency with drive dynamics means that the reference trajectory fulfills the differential equation of the drive dynamics and violates neither drive velocity constraints nor drive torque constraints.

A generation of the nominal state and input trajectory is optionally performed by using the non-linear model for the skew dynamics. That is to say that a simulation of the non-linear skew dynamic model and/or a simulation of the rotator unit model is/are implemented at the reference trajectory generator for calculation of a nominal state trajectory and/or a nominal input trajectory consistent with the aforementioned crane dynamics.

Further, a disturbance decoupling block of the reference trajectory generator decouples the skewing dynamics from the crane's slewing dynamics. That is to say that the slewing gear can still be manually controlled by the crane operator during an active skew control. The same may apply to the dynamics of the luffing gear. Consequently, the control of the skewing angle may be decoupled from the slewing gear and/or the luffing gear of the crane.

In a particular embodiment of the present disclosure the reference trajectory generator enables an operator triggered semi-automatic rotation of the load of a predefined angle, in particular of about 90° and/or 180°. That is to say the control unit offers certain operator input options which will proceed an semi-automatically rotation/skew of the attached load for a certain angle, ideally 90° and/or 180° in a clockwise and/or counter-clockwise direction. The operator may simply push a predefined button on a control stick to trigger an automatic rotation/skew of the load wherein the active skew control of the skew unit avoid torsional oscillations during skew movements.

The present disclosure is further directed to a skew control system for controlling the orientation of a crane load using any one of the methods described above. Such a skew control unit may include a 2-DOF control for the skew angle. The skew control system may include a reference trajectory generator and/or a state observer and/or a control unit for controlling the control signal of a rotator unit and/or slewing gear and/or luffing gear.

The present disclosure further comprises a boom crane, especially a mobile harbour crane, comprising a skew control unit for controlling the rotation of a crane load using any of the methods described above. Such a crane comprises a hook suspended on ropes, a rotator unit and a manipulator.

Advantageously, the crane will also comprise an anti-sway-control system that interacts with the system for controlling the rotation of a crane. The crane may also comprise a boom that can be pivoted up and down around a horizontal axis and rotated around a vertical axis by a tower. Additionally, the length of the rope can be varied.

Further advantages and properties of the present disclosure are described on the basis of embodiments shown in the figures.

BRIEF DESCRIPTION OF THE FIGURES

FIG. 12 shows measurement result of a slewing gear rotation of 90°.

FIG. 13A shows measurement results to demonstrate the usage of the semi-automatic container turning function.

FIG. 13B shows measurement results to demonstrate the usage of the semi-automatic container turning function FIG. 13C shows measurement results to demonstrate the usage of the semi-automatic container turning function.

DETAILED DESCRIPTION

Figure 1:
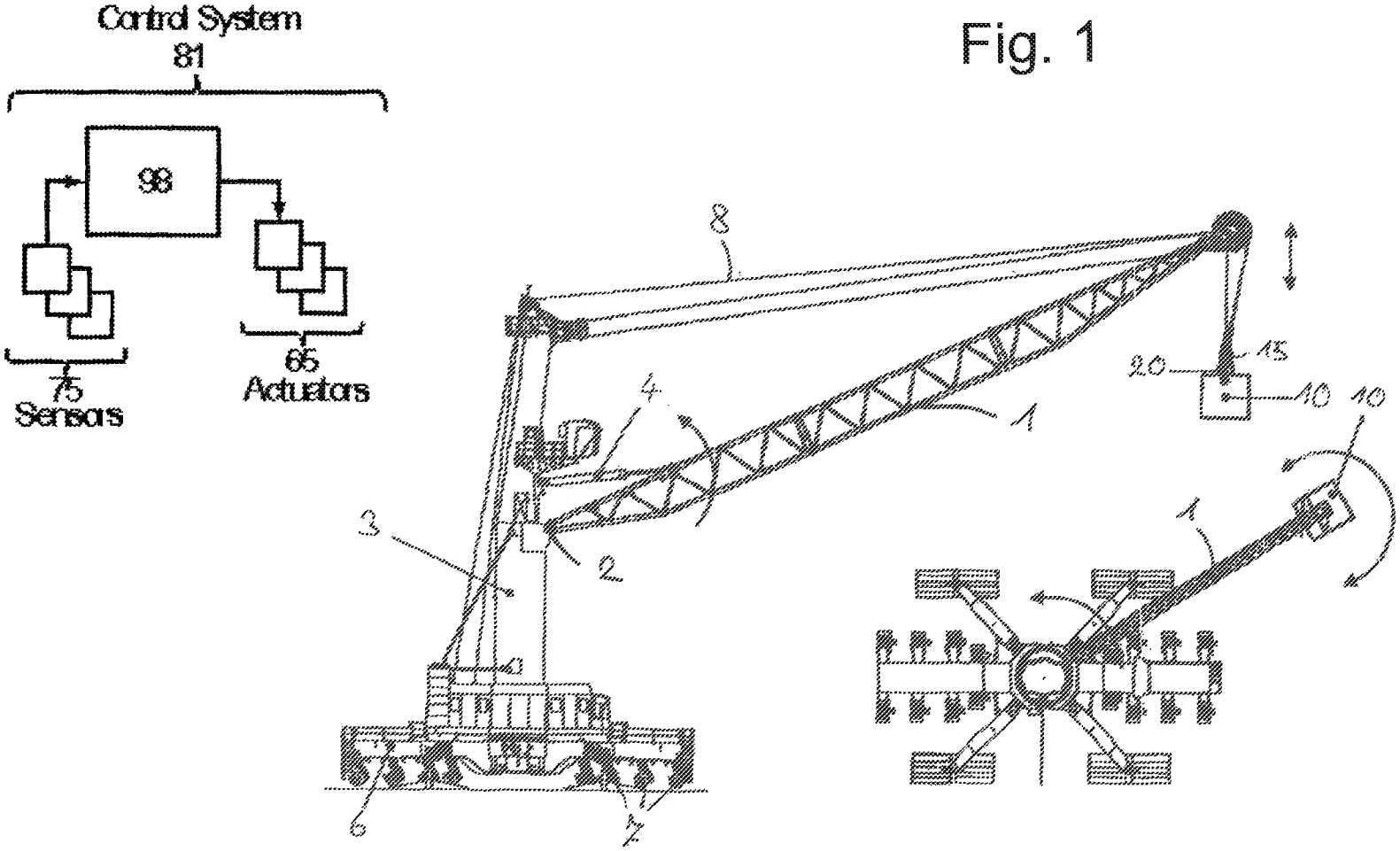
FIG. 1 shows a side view and a top view of a mobile harbour crane.

Boom cranes are often used to handle cargo transshipment processes in harbours. Such a mobile harbour crane is shown in FIG. 1. The crane has a load capacity of up to 124 t and a rope length of up to 80 m. However, the present disclosure is not restricted to a crane structure with the mentioned properties. The crane comprises a boom 1 that can be pivoted up and down around a horizontal axis formed by the hinge axis 2 with which it is attached to a tower 3. The tower 3 can be rotated around a vertical axis, thereby also rotating the boom 1 with it. The tower 3 is mounted on a base 6 mounted on wheels 7. The length of the rope 8 can be varied by winches. The load 10 can be grabbed by a manipulator or spreader 20, that can be rotated by a rotator unit 15 mounted in a hook suspended on the rope 8. The load 10 is rotated either by rotating the tower and thereby the whole crane, or by using the rotator unit 15. In practice, both rotations will have to be used simultaneously to orient the load in a desired position.

A control system 81 may be provided, for example positioned in or on or at the crane, reading information from various sensors 75 and/or estimates of parameters based on sensor and other data (including those sensors described herein), and adjusting actuators 65 in response thereto (including those actuators, such as motors, described herein). The control system may include an electronic analog and/or digital control unit for example including a physical processor and physical memory 98 with instructions stored therein for carrying out the various actions, including operating the controllers described herein.

Figure 2:
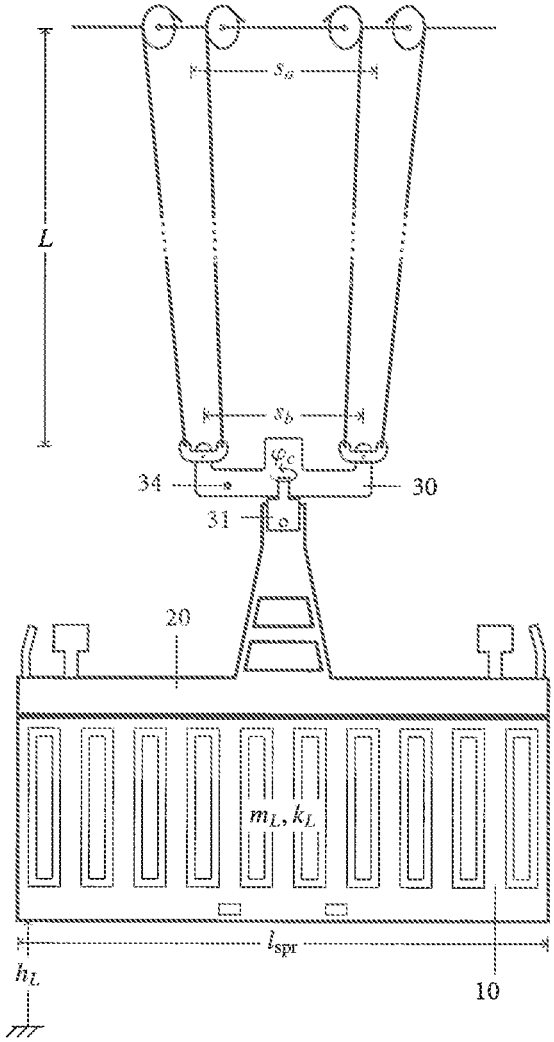
FIG. 2 shows a front view of the crane ropes, load rotator device, spreader and container.
Figure 8:
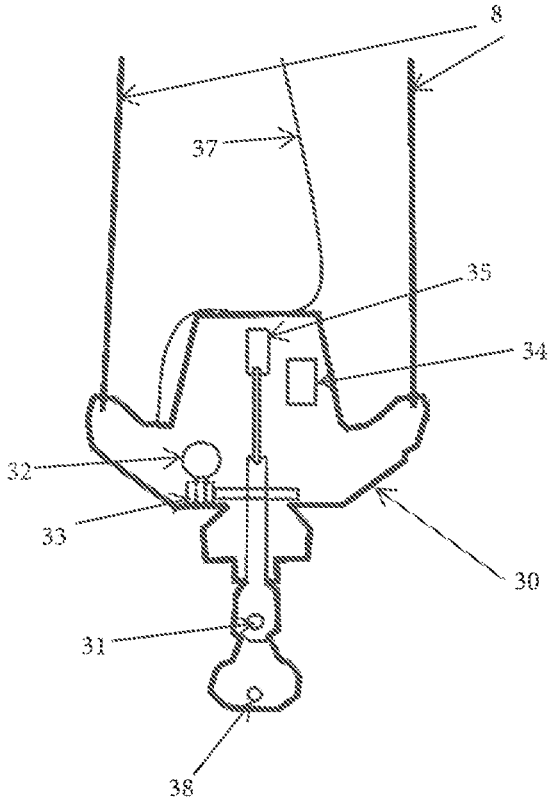
FIG. 8 shows a side view of a crane hook with installed components.

FIG. 2 discloses a detailed side view of a container 10 grabbed by the spreader 20. The spreader 20 is attached to the hook 30 by means of hinge 31 which is rotatable relative to the hook 30. The hook 30 is attached to the ropes 8 of the crane. A detailed view of the hook 30 is depicted in FIG. 8. The rotator unit effecting a rotational movement of the attached spreader relative to the hook 30 comprises a drive including rotator motor 32 and transmission unit 33. A power line 37 connects the motor 32 to the power supply of the crane. The hook 30 further comprises an inertial skew rate sensor 34 (gyroscope) and a drive position sensor 35 (incremental encoders). A spreader can be connected to the attaching means 38. In one example, the attaching means may include a connector having an interior opening and/or hole.

For simplicity, only the rotation of a load suspended on an otherwise stationary crane will be discussed here. However, the control concept of the present disclosure can be easily integrated in a control concept for the whole crane.

The present disclosure presents the skew dynamics on a boom crane along with an actuator model and a sensor configuration. Subsequently a two-degrees of freedom control concept is derived which comprises a state observer for the skew dynamics, a reference trajectory generator, and a feedback control law. The control system is implemented on a Liebherr mobile harbour crane and its effectiveness is validated with multiple test drives.

The novelties of this publication include the application of a nonlinear skew dynamics model in a 2-DOF control system on boom cranes, the real-time reference trajectory calculation method which supports operating modes such as perpendicular transfer of containers, and the experimental validation on a harbour cranes with a load capacity of 124 t.

2 Rotator Operation Modes

In this section, typical operating modes for container rotation during container transloading are discussed.

Figure 3A:
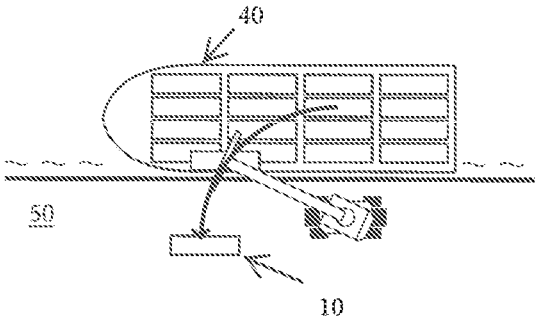
FIGS. 3A-C show an overview of the different operating modes for rotator control during container transloading, including a first mode in FIG. 3A, a second mode in FIG. 3B, and a third mode in FIG. 3C.
Figure 3B:
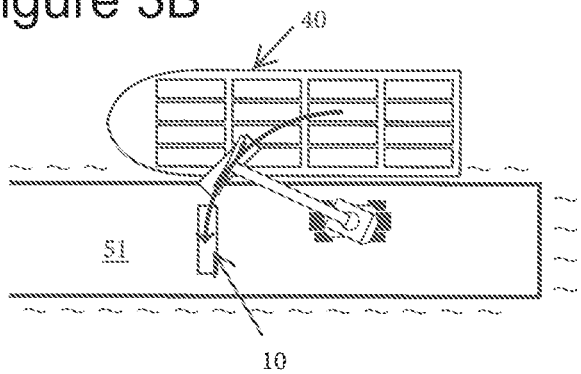
Figure 3C:
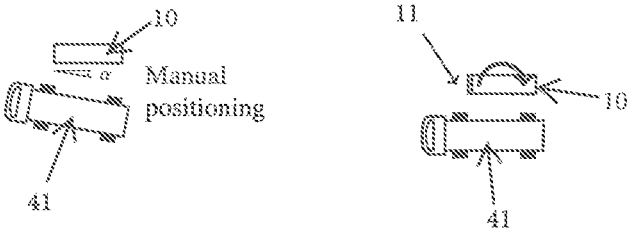

In most harbours, containers 10 are moved from a container vessel 40 to shore 50 without rotation. This is commonly called parallel transfer; see FIG. 3(*a*). On thin piers 51 ("finger piers") however, containers 10 need to be rotated by 90° to allow further transport using reach stackers. Such a perpendicular transfer is depicted in FIG. 3(*b*). When containers 10 are transferred to trucks or automated guided vehicles (AGVs) (reference number 41), the crane must precisely adjust the container skew angle to the truck orientation. Since container doors 11 must be at the rear end of a truck 41, containers 10 are sometimes turned by 180°. These processes are shown in FIG. 3(*c*).

Figure 4:
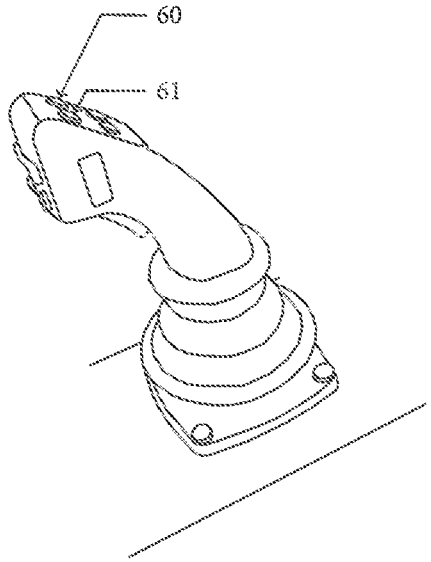
FIG. 4 shows a side view of a joystick with hand lever buttons for skew control.

FIG. 4 shows one of the hand levers of the crane operator. Two hand lever buttons 60, 61 are used for adapting the spreader orientation in either clockwise direction by pushing button 60 or counterclockwise direction by pushing button 61. The state of the art is that pushing one of these buttons induces a relative motion between the hook and the spreader in the desired direction. When no button is pressed, either the relative velocity between hook and spreader is forced to zero, or the actuator is set to zero-torque. In both cases the load motion will not stop when the operator releases the hand lever buttons, but either an undamped residual oscillation of the spreader will remain, or the spreader will remain in constant rotation. In both cases the operator has to compensate disturbances due to wind, crane slewing motion, friction forces, etc. himself.

When automatic skew control is enabled on a crane, the same user interface shall be used. This means that the operator shall control the spreader motion using only the two hand lever buttons. When there is no operator input, the skew angle shall be kept constant to allow parallel transfer of containers. This means that both known disturbances (e. g. slewing motion) and unknown disturbances (e. g. wind force) need to be compensated. Short-time button pushes shall yield small orientation changes to allow precise positioning. When a button is kept pushed for longer periods, the container is accelerated to a constant target speed, and it is decelerated again once the button is released. The target speed is chosen such that the braking distance is sufficiently small to ensure safe working conditions (the braking distance shall not exceed 45°). To simplify perpendicular transfer of containers or 180° container rotation, the skewing motion shall automatically stop at a given angle (90° or 180°) even if the operator keeps the button pressed.

3 Crane Rotator Model

Figure 5:
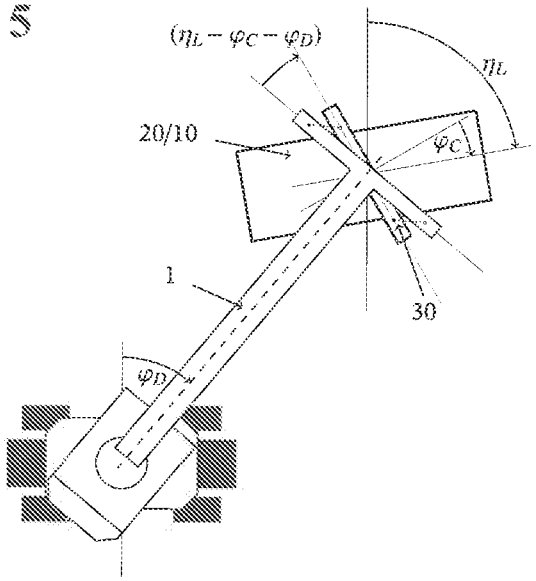
FIG. 5 shows a top view of the geometry and variables of the skew dynamics model.

According to the present disclosure a dynamic model for the skew angle is derived. As shown in FIG. 5, the skew angle of the load in inertial coordinates is referred to as $\eta_L$. The load can be an empty spreader 20 or a spreader 20 with a container 10 hooked onto it. The slewing angle of the crane is denoted as $\phi_D$, and the relative angle between the rotator device and the load is $\phi_C$. The directions of the angles are defined as shown in FIG. 5. Subsection 3.1 introduces a dynamic model of the skew dynamics, i. e. a differential equation for the skew angle $\sigma_L$. A drive model for the rotator angle $\phi_C$ is given in Subsection 3.2. Finally, the available sensor signals are presented in Subsection 3.3.

3.1 Load Rotation Dynamics

In this section, a model for the oscillation dynamics of the inertial skew angle $\eta_L$ is derived. The FIGS. 2, 5 and 6 visualize the angles and lengths appearing in the derivation.

Figure 6:
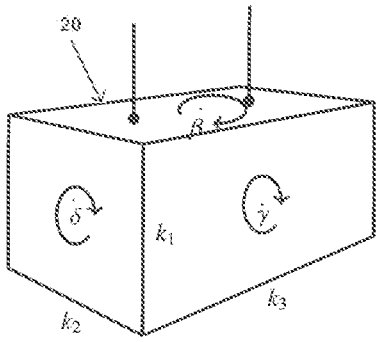
FIG. 6 shows an illustration of the cuboid model of the load.

The spreader (with or without a container) is assumed to be a uniform cuboid of dimensions $k_1 \times k_2 \times k_3$ with the mass $m_L$ (see FIG. 6). The cuboid's inertia tensor is then $$I = \frac{1}{12} m_L \begin{bmatrix} k_2^2 + k_3^2 & 0 & 0 \\ 0 & k_1^2 + k_3^2 & 0 \\ 0 & 0 & k_1^2 + k_2^2 \end{bmatrix}. \tag{1}$$

With the vertical position $h_L$, the horizontal position $x_L$, $y_L$ and the rotation rates $\dot{\beta}$, $\dot{\gamma}$, $\dot{\delta}$, and the gravitational acceleration g, the potential energy $\mathcal{V}$ and the kinetic energy $\mathcal{T}$ of the container are:

$$\mathcal{V} = m_L g h_L, \tag{2}$$

$$\begin{aligned} \mathcal{T} &= \frac{1}{2} m_L \left[\dot{h}_L^2 + \dot{x}_L^2 + \dot{y}_L^2\right] + \frac{1}{2} [\dot{\beta} \;\; \dot{\gamma} \;\; \dot{\delta}] I \begin{bmatrix} \dot{\beta} \\ \dot{\gamma} \\ \dot{\delta} \end{bmatrix} \\ &= \frac{1}{2} m_L \left[\dot{h}_L^2 + \dot{x}_L^2 + \dot{y}_L^2\right] + \\ &\quad \frac{1}{24} m_L \left[(k_2^2 + k_3^2)\dot{\beta}^2 + (k_1^2 + k_3^2)\dot{\gamma}^2 + (k_1^2 + k_2^2)\dot{\delta}^2\right]. \end{aligned} \tag{3}$$

Both (2) and (3) are combined to the Lagrangian $\mathcal{L} = \mathcal{T} - \mathcal{V}$. In order to apply the Euler-Lagrange equation $$\frac{d}{dt} \frac{\partial \mathcal{L}}{\partial \dot{\eta}_L} = \frac{\partial \mathcal{L}}{\partial \eta_L}, \tag{4}$$

it must be identified which terms in (2) and (3) depend on either the skew angle $\eta_L$ or its derivative $\dot{\eta}_L$:

- The vertical load position $h_L$ depends on $\eta_L$: When the container rotates around the vertical axis, it is slightly lifted upwards due to the cable suspension. The exact dependency is derived in the following.
- Since a rotation of the load does not move the center of gravity of the load horizontally, the horizontal load position coordinates $x_L$ and $y_L$ do not depend on $\eta_L$.
- In typical crane operating conditions, the load angles $\gamma$ and $\delta$ are very small. This means that the angle $\beta$ coincides with the container orientation $\eta_L$. Since $\gamma$ and $\delta$ are orthogonal to $\beta$, they do not depend on $\eta_L$.

The Lagrangian can therefore be represented as:

$$\mathcal{L} = \frac{1}{2} m_L \dot{h}_L^2 + \frac{1}{24} m_L \underbrace{(k_2^2 + k_3^2)}_{k_L^2} \dot{\eta}_L^2 - m_L g h_L. \tag{5}$$

Figure 7:
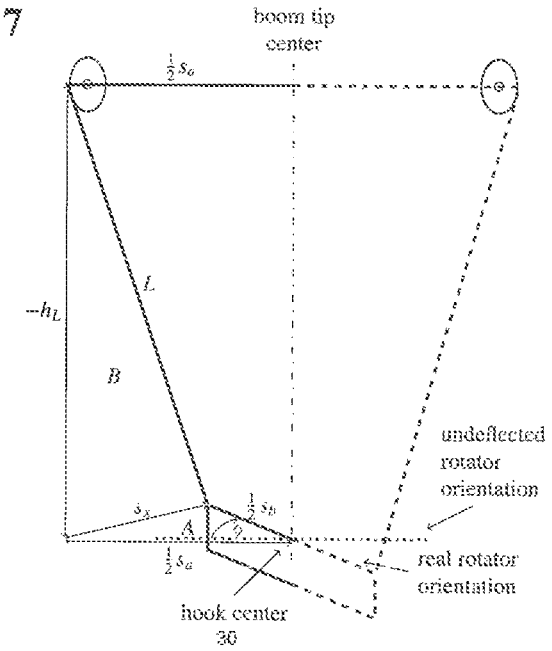
FIG. 7 shows a sketch of the boom tip, ropes and hook in a deflected situation.

In order to apply (4) to (5), the relative load height $h_L$ needs to be written as a function of the rotator deflection (i. e. the twist angle $\Diamond = \eta_L - \phi_C - \phi_D$). FIG. 7 shows the rotator in a deflected state. The cosine formula for the triangle A is:

$$s_x^2 = \left(\frac{s_a}{2}\right)^2 + \left(\frac{s_b}{2}\right)^2 - 2\frac{s_a}{2}\frac{s_b}{2}\cos(\eta_L - \varphi_C - \varphi_D). \tag{6}$$

With $s_x$ known, geometric considerations in triangle B reveal $$-h_L = \sqrt{L^2 - s_x^2}, \tag{7}$$

which yields:

$$h_L = -\sqrt{L^2 - \frac{s_a^2}{4} - \frac{s_b^2}{4} + \frac{s_a s_b}{2}\cos(\eta_L - \varphi_C - \varphi_D)}\,. \tag{8}$$

Using (5) and (8), the Euler-Lagrange formalism (4) yields the differential equation (9) which describes the skew dynamics.

$$k_L^2 m_L \ddot{\eta}_L + \frac{m_L s_a^2 s_b^2 \xi_2^2}{4\xi_1}(\ddot{\eta}_L - \ddot{\varphi}_C - \ddot{\varphi}_D) = \underbrace{-\frac{m_L s_a^2 s_b^2 \xi_2 \xi_4^2}{4\xi_1}}_{*}\left(\frac{s_a s_b \xi_2^2}{\xi_1} + \xi_3\right) - \underbrace{\frac{m_L g s_a s_b \xi_2}{2\sqrt{\xi_1}}}_{\blacksquare} \tag{9a}$$

$$\text{with } \xi_1 = 4L^2 - s_a^2 - s_b^2 + 2 s_a s_b \xi_3 \tag{9b}$$

$$\xi_2 = \sin(\eta_L - \varphi_C - \varphi_D) \tag{9c}$$

$$\xi_3 = \cos(\eta_L - \varphi_C - \varphi_D) \tag{9d}$$

$$\xi_4 = \dot{\varphi}_C + \dot{\varphi}_D - \dot{\eta}_L \tag{9e}$$

The following assumptions are used to simplify equation (9):

The rope distances are significantly smaller than the rope length: $s_a \ll L$, $s_b \ll L$.

The term marked as * can be neglected when being compared with the term marked as ■: Even for short rope lengths ($L_{min} \approx 5$ m) and high rotational rates $$\left(|\xi_4|_{max} \approx 0.8\frac{\text{rad}}{\text{s}}\right),\ \frac{s_a s_b}{L}\xi_4^2 \le \frac{s_a s_b}{L_{min}}|\xi_4|_{max}^2 \approx 0.5\ \text{m/s}^2 \ll g_{holds}.$$

Due to the rotational inertia which is represented by the radius of gyration $k_L$ which was defined in (5), the translational inertia is negligible:

$$\frac{1}{16} m_L \frac{s_a^2 s_b^2}{L^2} \ll m_L k_L^2.$$

With these assumptions, the skew dynamics (9) can be denoted as $$m_L k_L^2 \ddot{\eta}_L = \underbrace{-m_L \frac{g}{L}\frac{s_a s_b}{4}\sin(\eta_L - \varphi_C - \varphi_D)}_{T}. \tag{10}$$

The right-hand side of (10) is the torque T exerted on the load. The product of the halve rope distances is abbreviated as $$A = \frac{s_a s_b}{4} \tag{11}$$

which is a parameter that is known from the crane geometry. Combining (10) and (11) yields the skew dynamics model $$\ddot{\eta}_L = -\frac{g}{L}\frac{A}{k_L^2}\sin(\eta_L - \varphi_C - \varphi_D). \tag{12}$$

Equation (12) illustrates that the eigenfrequency of the skew dynamics is independent of the load mass, i. e. only depends on the geometry and on the gravitational acceleration. Also, (12) illustrates that it is not reasonable to leave the deflection range $$-\frac{\pi}{2} \le \eta_L - \varphi_C - \varphi_D \le \frac{\pi}{2} \tag{13}$$

since larger deflections do not yield higher torques.

3.2 Actuator Model

The skewing device rotates the spreader with respect to the hook (see FIG. 8). The relative angle is denoted as $\phi_C$. If the rotator is hydraulically actuated the control signal u (sent to an actuator) can be a valve position which is proportional to the rotator speed. If the rotator is electrically actuated the control signal u can be a rotation rate set-point. Assuming first-order lag dynamics with a time constant $T_S$, the actuator dynamics can be denoted as:

$$T_S \ddot{\phi}_C + \dot{\phi}_C = u. \tag{14}$$

The actuator system is subject to two contraints. First, the control signal u cannot exceed given limits:

$$u_{min} \le u \le u_{max}. \tag{15}$$

Second, the drive system is limited in torque and/or pressure and/or current, therefore only a certain skew torque $T_{max}$ can be applied by the actuators. Considering (10), the skew torque constraint is:

$$\left|m_L \frac{g}{L} A \sin(\eta_L - \varphi_C - \varphi_D)\right| \le T_{max}. \tag{16}$$

This constraint is important for trajectory generation since the system will inevitably deviate from the reference trajectory if the constraint is violated.

3.3 Sensor Models

There are two sensors installed in the hook housing (see FIG. 8). An incremental encoder is used for measuring the drive position $$y_1=\varphi_C. \tag{17}$$

Since the incremental encoder gives a reliable measurement signal, the drive speed $\dot{\varphi}_C$ is found by discrete differentiation of the drive position. For measuring the skew dynamics, a gyroscope is installed in the hook housing, which measures its inertial skewing rate. The gyroscope measurement is disturbed by a signal bias and sensor noise:

$$y_2=\dot{\eta}-\dot{\varphi}_C+\nu_{offset}+\nu_{noise}. \tag{18}$$

The slewing angle of the crane is also measured by an incremental encoder (see FIG. 5):

$$y_3=\varphi_D. \tag{19}$$

Furthermore the rope length L of the crane is measured precisely, and the spreader length $l_{apr}$ is known from the spreader actuation signal (see FIG. 2). From the spreader length, the radius of gyration $k_L$ can be calculated. For calculating the radius of gyration, the following parts have to be taken into account:

- the crane hook, which however gives very little rotational inertia,
- the empty spreader, which has a length-dependent mass distribution that is known from the spreader manufacturer,
- if attached, the steel container, whose (length-dependent) mass distribution is known from identification experiments,
- if present, the load inside the container, which is simply assumed to be equally distributed over the (length-dependent) container floor space.

The crane's load measurement is only used to decide if the container has to be taken into account for the calculation of the radius of gyration $k_L$.

4 Control Concept

Figure 9:
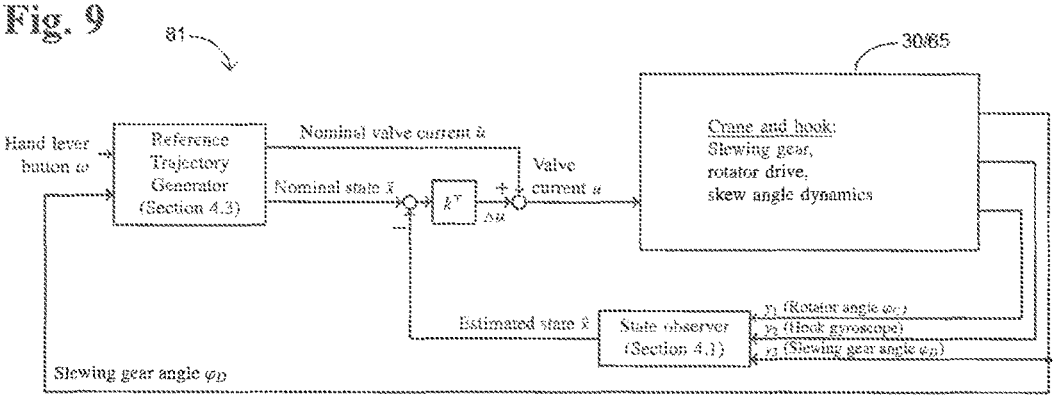
FIG. 9 shows a schematic for the two-degree of freedom control for the skew angle.

For the skew control, two-degree of freedom control is used as shown in FIG. 9. This means that the control signal u comprises a feedforward signal $\tilde{u}$ from a reference trajectory generator, and a feedback signal $\Delta u$ to stabilize the system and reject disturbances:

$$u=\tilde{u}+\Delta u. \tag{20}$$

The feedforward control signals is designed in such a way that it drives the system along a reference trajectory $\tilde{x}$ under nominal conditions. Any deviation of the estimated system state $\tilde{x}$ to the reference state $\tilde{x}$ is compensated by the feedback signal $\Delta u$ using the feedback gain vector $k^T$:

$$\Delta u=k^T(\tilde{x}-\hat{x}). \tag{21}$$

The system state x comprises the rotator angle $\varphi_C$, rotator angular rate $\dot{\varphi}_C$, the skew angle $\eta_L$ and the skew angular rate $\dot{\eta}_L$:

$$x=\begin{bmatrix}\varphi_C\\ \dot{\varphi}_C\\ \eta_L\\ \dot{\eta}_L\end{bmatrix}. \tag{22}$$

In Section 4.1, a state observer is presented which finds the state estimate $\hat{x}$ for the real system state x using the measurement signals. The design of the feedback gain $k^T$ is discussed in Section 4.2. Finally, the reference trajectory generator which calculates $\tilde{u}$ and $\tilde{x}$ is shown in Section 4.3.

4.1 State Observer

The aim of the state observer is to estimate those states of the state vector (22) which cannot be measured or whose measurements are too disturbed to be used as feedback signals. Both states of the actuator dynamics are measured using an incremental encoder. This means that $\varphi_C$ and $\dot{\varphi}_C$ are known and do not need to be estimated. The two states of the skew dynamics, the skew angle $\eta_L$ and its angular velocity $\dot{\eta}_L$, are not directly measurable. They are estimated using a Luenberger-type state observer. The gyroscope measurement (18) is used as feedback signal for the observer. Since the gyroscope measurement carries a signal offset $\nu_{offset}$, an augmented observer model is introduced for observer design, i. e. the observer state vector $z_{spiel}$ comprises the skew angle $\eta_L$, the skew rate $\dot{\eta}_L$ and the signal offset $\nu_{offset}$ and the skewing rate $\nu_{spiel}$ caused by the slackness of the hook and the time derivative $\hat{\nu}_{spiel}$ thereof:

$$z_s=\begin{bmatrix}z_1\\ z_2\\ z_3\\ z_4\\ z_5\end{bmatrix}=\begin{bmatrix}\eta_L\\ \dot{\eta}_L\\ \nu_{offset}\\ \nu_{spiel}\\ \dot{\nu}_{spiel}\end{bmatrix}. \tag{23}$$

The nominal dynamics of $z_s$ are found by combining (12) with a random-walk offset model:

$$\dot{z}_s=\begin{bmatrix}z_2\\ -\frac{g}{L}\frac{A}{k_L^2}\sin(z_1-\varphi_C-\varphi_D)\\ 0\\ z_5\\ -\left(\frac{2\Pi}{1s}\right)^2 z_4\end{bmatrix}, \tag{24a}$$

$$y_2=z_2-\dot{\varphi}_C+z_3+z_4. \tag{24b}$$

The observer is found by adding a Luenberger term to (24). The estimates state vector is denoted as $\hat{z}_s$. The signals $\varphi_C$, $\varphi_D$, and $\dot{\varphi}_C$ are taken from the measurements (17) and (19):

$$\dot{\hat{z}}_s=\begin{bmatrix}\hat{z}_2\\ -\frac{g}{L}\frac{A}{k_L^2}\sin(z_1-y_1-y_3)\\ 0\\ \hat{z}_5\\ -\left(\frac{2\Pi}{1s}\right)^2\hat{z}_4\end{bmatrix}+\begin{bmatrix}l_1\\ l_2\\ l_3\\ l_4\\ l_5\end{bmatrix}(y_2-\hat{y}_2), \tag{25a}$$

$$\hat{y}_2=\hat{z}_2-\dot{y}_1+\hat{z}_3+\hat{z}_4. \tag{25b}$$

The feedback gains $l_1$, $l_2$, $l_3$, $l_4$ and $l_5$ and are found by pole placement to ensure required convergence times after situations with model mismatch. A typical example for model mismatch is a collision with a stationary obstacle (e. g. another container). For the pole placement procedure, a set-point linearization of the observer model is used.

From the estimated state vector $\hat{z}_s$, the estimated skew angle and the skew rate are forwarded to the 2-DOF control, along with the actuator state measurements. The estimated gyroscope offset is not considered further:

$$\hat{x} = \begin{bmatrix} y_1 \\ \dot{y}_1 \\ \hat{z}_1 \\ \hat{z}_2 \end{bmatrix}. \tag{26}$$

4.2 Stabilization

Since both the skew dynamics (12) and the actuator dynamics (14) have open loop poles on the imaginary axis, any disturbance (e. g. wind) or error in the initial state estimate will cause non-vanishing deviations in between the reference trajectory $\tilde{x}$ and the system trajectory x. Feedback control is added to ensure that the system converges to the reference trajectory (see FIG. 9). The feedback control is accomplished by calculating the control error $$e=\tilde{x}-x \tag{27}$$

and designing the feedback gain k with $$k^T=[k_1 k_2 k_3 k_4] \tag{28}$$

for eq. (21) such that the control error is asymptotically stable. For the feedback design, a set-point linearization is considered. Afterwards it is verified that the feedback law stabilizes the nonlinear system model.

Assuming both the reference trajectory and the plant dynamics fulfill the model equations (12) and (14), the error dynamics can be found by differentiating (27) and plugging-in the model equations:

$$\dot{e} = \dot{\tilde{x}} - \dot{x} = \begin{bmatrix} \tilde{x}_2 \\ -\frac{1}{T_S}(\tilde{x}_2 - \tilde{u}) \\ \tilde{x}_4 \\ -\frac{gA}{Lk_L^2}\sin(\tilde{x}_3 - \tilde{x}_1) \end{bmatrix} - \begin{bmatrix} x_1 \\ -\frac{1}{T_S}(x_2 - u) \\ x_4 \\ -\frac{gA}{Lk_L^2}\sin(x_3 - x_1) \end{bmatrix}. \tag{29}$$

Together with the control equations (20), (21), and (28), and assuming the state estimation works sufficiently well ($\hat{x}-x$), the set-point linearization of (29) is $$\dot{e} = \underbrace{\begin{bmatrix} 0 & 1 & 0 & 0 \\ -\frac{k_1}{T_S} & -\frac{1+k_2}{T_S} & -\frac{k_3}{T_S} & -\frac{k_4}{T_S} \\ 0 & 0 & 0 & 1 \\ \frac{g}{L}\frac{A}{k_L^2} & 0 & -\frac{g}{L}\frac{A}{k_L^2} & 0 \end{bmatrix}}_{\Phi} e. \tag{30}$$

With the abbreviation $$\theta = \frac{g}{L}\frac{A}{k_L^2},$$

the characteristic polynomial of the dynamic matrix $\Phi$ is:

$$\det(\lambda I - \Phi) = \frac{(k_1 + k_3)\theta + (k_2 + k_4 + 1)\theta\lambda + (k_1 + T_S\theta)\lambda^2 + (k_2 + 1)\lambda^3 + T_S\lambda^4}{T_S} \tag{31}$$

Figure 10:
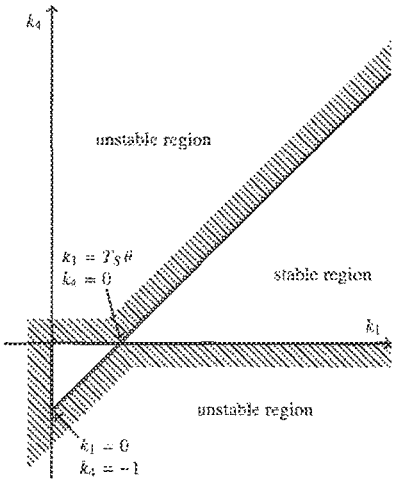
FIG. 10 shows a diagram disclosing the closed-loop stability region.

For any parameters $\theta$ and $T_S$, the feedback gains $k_1, \ldots k_4$ can be chosen in such a way that (31) is a Hurwitz polynomial. The final feedback gains can be chosen by various methods. A graphical tool are stability plots. For example, the stability region for $k_2=k_3=0$ is depicted in FIG. 10, which shows the constraints on the choice for the remaining coefficients $k_1$ and $k_4$ for this case.

4.3 Reference Trajectory Generation

As shown in FIG. 9, the reference trajectory generator needs to calculate a nominal state trajectory $\tilde{x}$ as well as a nominal input trajectory $\tilde{u}$ which is consistent with the plant dynamics. Since the skew system is operator-controlled, the reference trajectory needs to be planned online in real-time.

The general structure is known which uses a plant simulation to generate a reference state trajectory and an arbitrary control law for generating a control input for the plant simulation. The control input for the simulated plant is then used as a nominal control signal for the real system. In order to adapt this approach to the skew control problem, simulations of the actuator model and the skew model are implemented for generating a reference state trajectory from a reference input signal. In this design, the combined angle $$\tilde{\phi}_{CD}=\phi_C+\phi_D \tag{36}$$

is used instead of the actuator angle $\phi_C$ and the slewing gear angle $\phi_D$ at first. The two variables are later decoupled as discussed in Section 4.3.3. The remainder of this section discusses the control law which is used to stabilize the plant simulation.

Since the cut-off frequency of the actuator dynamics is significantly faster than the eigenfrequency of the skew dynamics, cascade control is applied inside the reference trajectory planner. This means that a skew reference controller is set up for stabilizing the simulated skew dynamics, and an underlying actuator reference controller is used for stabilizing the simulated actuator dynamics. The target value of the skew control loop is the target velocity $\dot{\tilde{\eta}}_{L,target}$ from the operator, and the target value of the underlying actuator control loop comes from the skew control loop. A disturbance decoupling block is added to decouple the skewing dynamics from the crane's slewing dynamics, i. e. reverting (36). Finally, the automatic deceleration at position constraints after 90° or 180° of motion are enforced by modification of the target velocity for the whole reference control loop.

The skew reference control loop is explained in Subsection 4.3.1, followed by the actuator reference control loop in Subsection 4.3.2. Subsequently, the decoupling of the slewing gear motion is shown in Subsection 4.3.3. Finally, the determination of the target velocity is discussed in Subsection 4.3.4.

4.3.1 Skew Reference Controller

The aim of the skew reference controller is to stabilize the skew dynamics simulation $$\ddot{\tilde{\eta}}_L = -\frac{gA}{Lk_L^2}\sin(\tilde{\eta}_L - \hat{\varphi}_{CD}) \tag{37}$$

and to ensure that it tracks the target velocity $\dot{\tilde{\eta}}_{L,target}$, For this purpose the control law $$\tilde{\phi}_{CD,target}=\tilde{\eta}_L+\mathrm{sat}_\eta(K_\eta\cdot(\dot{\tilde{\eta}}_{L,target}-\dot{\tilde{\eta}}_L \tag{38}$$

is introduced with the saturation function $$sat_\eta(x)=\mathrm{sign}(x)\cdot\min\left(\Delta\eta_{max},\ \arcsin\left(\frac{LT_{max}}{gAm_L}\right),\ |x|\right). \tag{39}$$

The saturation function ensures that the target rope deflection neither exceeds the deflection which corresponds to maximum actuator torque as in (16), nor the maximum deflection angle $\Delta\eta_{max}$. The maximum deflection $\Delta\eta_{max}<$ $$\Delta\eta_{max}<\frac{\pi}{2}$$

ensures that the reference trajectory does not deflect the hook beyond the maximum torque angle as in (13), and that there is a reasonable safety margin in case of control deviation.

Assuming $\tilde{\phi}_{CD}\approx\tilde{\phi}_{CD,target}$, get the skew dynamics (37) with the control law (38) breaks down to $$\ddot{\tilde{\eta}}_L=\frac{gA}{Lk_L^2}\sin\left(sat_\eta\left(K_\eta\cdot(\dot{\tilde{\eta}}_{L,target}-\dot{\tilde{\eta}}_L)\right)\right) \tag{40}$$

A stability analysis of (40) reveals that for any positive $K_\eta$ the load skew rate $\dot{\tilde{\eta}}_L$ converges to any constant target velocity $\dot{\tilde{\eta}}_{L,target}$. The feedback gain $K_\eta$ is chosen by gain scheduling in dependence of the skew eigenfrequency. It ensures quick convergence with minimum overshoot.

4.3.2 Actuator Reference Controller

The underlying control loop consists of the plant $$\ddot{\tilde{\varphi}}_{CD}=\frac{\tilde{u}_{CD}-\dot{\tilde{\varphi}}_{CD}}{T_S} \tag{41}$$

and the actuator reference controller which is designed using the following model predictive control approach. The actuator reference controller is designed such that the cost function $$\min_{\tilde{u}_{CD}(t)}\int_0^{T_{predict}} q_\varphi(\tilde{\varphi}_{CD}-\tilde{\varphi}_{CD,target})^2+q_{\tilde{u}}\tilde{u}_{CD}^2+q_s s^2\,dt \tag{42}$$

is minimized. Here, $s\geq 0$ is a high-weighted slack variable which is introduced to ensure that the following set of input and state constraints is always feasible:

$$\tilde{u}_{CD}(t)\leq u_{max}, \tag{43}$$

$$-\tilde{u}_{CD}(t)\leq -u_{min}, \tag{44}$$

$$\tilde{\phi}_{CD}(t)-s(t)\leq\tilde{\eta}_L+\mathrm{sat}_\eta(\infty), \tag{45}$$

$$-\tilde{\phi}_{CD}(t)-s(t)\leq-\tilde{\eta}_L+\mathrm{sat}_\eta(\infty). \tag{46}$$

The input constraints (43)-(44) ensure that the valve limitations (15) are not violated. The state constraints (45)-(46) are used to prevent remaining overshot with respect to the hook deflection constraint (39).

The optimal control problem (42)-(46) is discretized and solved using an interior point method.

4.3.3 Disturbance Decoupling

So far, reference values for the combined angle $\tilde{\phi}_{CD}$ were calculated. As defined in (36), $\tilde{\phi}_{CD}$ comprises the rotator angle and the slewing gear angle. However, the reference trajectory planner needs to calculate a nominal trajectory for the rotator angle $\tilde{\phi}_C$ only. Since the crane's slewing gear motion is known to the crane control system, it can be easily decoupled using the following formulas:

$$\tilde{\phi}_C=\tilde{\phi}_{CD}-\phi_D, \tag{47a}$$

$$\dot{\tilde{\eta}}=\dot{\tilde{\eta}}_{CD}-\dot{\phi}_D, \tag{47b}$$

$$\tilde{\mu}=\tilde{\mu}_{CD}-(\dot{\phi}_D+T_s\ddot{\phi}_D). \tag{47c}$$

Equation (47a) directly reverts (36). Equation (47b) is found by differentiating (47a), and (47c) is found by further differentiation, and applying the actuator model (14) as well as (41).

4.3.4 Determination of the Target Velocity

The operator can only push joystick buttons in an on/off manner to operate the skewing system, i. e. the hand lever signal is $$\omega\in\{-1,0,+1\}. \tag{48}$$

The target velocity $\dot{\tilde{\eta}}_{L,target}$ for the skew reference controller is found by multiplying the joystick button signal with a reasonable maximum speed:

$$\dot{\tilde{\eta}}_{L,target}=\dot{\tilde{\eta}}_{L,max}\cdot\omega. \tag{49}$$

When the operator keeps a joystick button pressed permanently, the target velocity $\dot{\tilde{\eta}}_{L,target}$ is overwritten with 0 at some point to stop the skewing motion. The time instant of starting to overwrite the joystick button with 0 is chosen such that the systems comes to rest exactly at the desired stopping angle $\tilde{\eta}_{stop}$. The stopping angle $\tilde{\eta}_{stop}$ is chosen application dependently. For turning a container frontside back, $\eta_{stop}$ is chosen 180° after the starting point. To identify the right point in time for overwriting the hand lever signal with 0, a forward simulation of the trajectory generator dynamics is conducted in every sampling interval with a target velocity of 0, yielding a stopping angle prediction $\tilde{\eta}_{pred}$. When this prediction reaches the desired stopping angle $\tilde{\eta}_{stop}$, further motion is inhibited in this direction, i.e. (49) is replaced by:

$$\dot{\tilde{\eta}}_{L,target}=\begin{cases}0 & \text{if } \omega>0\wedge\tilde{\eta}_{pred}\geq\tilde{\eta}_{stop}\\ 0 & \text{if } \omega<0\wedge\tilde{\eta}_{pred}\leq\tilde{\eta}_{stop}.\\ \dot{\tilde{\eta}}_{L,max}\cdot\omega & \text{else}\end{cases} \tag{50}$$

Figure 11:
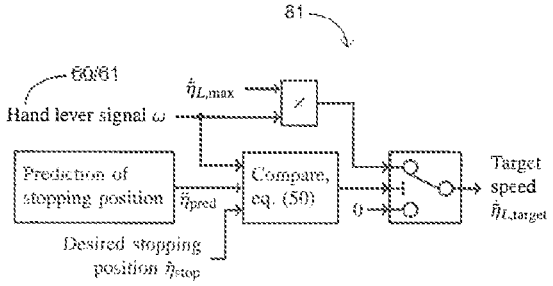
FIG. 11 shows a signal flow chart for determining the target speed.

For the sake of clarity, the full target speed determination signal flow is shown in FIG. 11.

5 Experimental Validation

To validate the practical implementation of the presented skew control system, two experiments are presented in this section. These experiments were chosen to reflect typical operating conditions as discussed in Section 2. The experiments were conducted on a Liebherr LHM 420 boom crane.

5.1 Compensation of Crane Slewing Motion

When the containers can be moved from ship to shore at a constant skew angle, the most important feature of the presented control system is the decoupling of the skew dynamics from the slewing gear. FIG. 12 shows a measurement of a slewing gear rotation of 90°. It can be seen that the rotator device $\phi c_{moves}$ inversely to the slewing gear $\phi_D$, yielding a constant container orientation $\eta_L$. The control deviation is small all the time. The control deviation plot especially shows that the residual sway converges to amplitudes $\ll 1°$ when the system comes to rest.

5.2 Large Angular Rotation

To demonstrate the usage of the semi-automatic container turning function, another test drive is shown in FIG. 13. The container orientation is shown in FIG. 13*a*, the angular rate is shown in FIG. 13*b* and the control deviation is plotted in FIG. 13*c*. When the operator presses the rotation button at the situation marked as (α), the rotator starts moving and twists the ropes. During the motion, the rotator speed equals the load speed. In the situation marked as (β), the rotator moves in inverse direction and decelerates the load. The system comes to rest after 180° rotation, which corresponds to the choice of the stopping angle $\tilde{\eta}_{stop}$ during this test drive. The deceleration at (β) is initialized automatically even though the operator does not release the rotation button. At (γ) and (δ), the same motion occurs in opposite direction.

6 Conclusion

A nonlinear model for the skew dynamics of a container rotator of a boom crane and a suitable control system for the skew dynamics have been presented. The control system is implemented in a two-degrees of freedom structure which ensures stabilization of the skew angle, decoupling of slewing gear motions and simplifies operator control. A linear control law is shown to stabilize the system by use of the circle criterion. The system state is reconstructed from a skew rate measurement using a Luenberger-type state observer. The reference trajectory for the control system is calculated from the operator input in real-time using a simulation of the plant model. The simulation comprises appropriate control laws which ensure that the reference trajectory tracks the operator signal and maintains system constraints. The performance of the control system is validated with test drives on a full-size mobile harbour boom crane.

The invention claimed is:

1. A method for controlling an orientation of a crane load via a crane system with a manipulator for manipulating the load connected by a rotator unit to a hook suspended on ropes, comprising:

controlling a skew angle of the load by a control unit of a crane, wherein the control unit is an adaptive control unit wherein an estimated system state of the crane system is determined with a nonlinear model describing skew dynamics during operation;

wherein nonlinearity of the model describing the skew dynamics includes a nonlinear relation between a load deflection angle and a resulting reactive torque, wherein the nonlinear model is independent of load mass or a moment of inertia of the load mass, and wherein the estimated system state includes an estimated skew angle and/or a velocity of the skew angle and/or one or more parasitic oscillations of a skew system.

2. The method according to claim 1, wherein the control unit includes a controller programmed therein including a 2-degree of freedom control comprising a state observer for estimation of the system state, a reference trajectory generator for generation of a reference trajectory in response to a user input, and a feedback control law for stabilization of the nonlinear skew dynamic model.

3. The method according to claim 2, wherein the state observer receives measurement data from sensors comprising at least a drive position of the rotator unit and/or an inertial skewing rate and/or a slewing angle of the crane.

4. The method according to claim 2, wherein the state observer is a Luenberger-type state observer.

5. The method according to claim 2, wherein the state observer is implemented without a Kalman filter.

6. The method according to claim 2, wherein the reference trajectory generator calculates a nominal state trajectory and/or a nominal input trajectory which is consistent with the skew dynamics and/or rotator drive dynamics and/or measured crane tower motion.

7. The method according to claim 6, wherein a simulation of the nonlinear skew dynamic model and/or a simulation of the rotator unit is/are implemented at the reference trajectory generator for calculation of a nominal state trajectory and/or a nominal input trajectory consistent with crane dynamics.

8. The method according to claim 7, wherein a disturbance decoupling block of the reference trajectory generator decouples the skewing dynamics from the crane's slewing dynamics.

9. The method according to claim 8, wherein the reference trajectory generator enables an operator triggered semi-automatic rotation of the load of a predefined angle.

10. The method according to claim 1, wherein control of the skewing angle is decoupled from a slewing gear and/or a luffing gear of the crane.

11. The method according to claim 1, wherein the crane system includes a boom crane.

12. The method according to claim 1, wherein the crane system includes a mobile harbour crane.

13. A method for controlling an orientation of a crane load via a crane system with a manipulator for manipulating the load connected by a rotator unit to a hook suspended on ropes, comprising:

adjusting a skew angle of the load with an actuator via a control unit of a crane having an adaptive digital controller, the control unit including instructions stored therein for reading information from one or more sensors, estimating a system state of the crane with a nonlinear model describing skew dynamics during crane operation, wherein the skew angle is adjusted based on the estimated system state, and wherein the crane system includes a boom crane.

14. The method of claim 13, wherein the crane system further includes a spreader, the method further comprising automatically damping pendulum oscillations with an anti-sway system including damping torsional oscillations with a rotational actuator in response to operating parameters, wherein the skew angle is not restricted to a limited angle range.

15. The method of claim 14, wherein the skew angle includes rotation of the spreader and crane load around a vertical axis with respect to ground, with the vertical axis arranged in a direction of gravity.

* * * * *